US010595617B2

(12) United States Patent
Teal, Jr.

(10) Patent No.: US 10,595,617 B2
(45) Date of Patent: Mar. 24, 2020

(54) PORTABLE SEAT

(71) Applicant: Steven W. Teal, Jr., Danville, NH (US)

(72) Inventor: Steven W. Teal, Jr., Danville, NH (US)

( * ) Notice: Subject to any disclaimer, the term of this patent is extended or adjusted under 35 U.S.C. 154(b) by 0 days.

(21) Appl. No.: 15/951,633

(22) Filed: Apr. 12, 2018

(65) Prior Publication Data

US 2018/0295973 A1 Oct. 18, 2018

Related U.S. Application Data

(60) Provisional application No. 62/486,641, filed on Apr. 18, 2017.

(51) Int. Cl.

| | |
|---|---|
| ***A47C 9/10*** | (2006.01) |
| ***A45F 3/26*** | (2006.01) |
| ***A47C 4/16*** | (2006.01) |
| ***A47C 4/12*** | (2006.01) |
| *A47C 4/28* | (2006.01) |

(52) U.S. Cl.

CPC ..... *A45F 3/26* (2013.01); *A47C 4/12* (2013.01); *A47C 4/16* (2013.01); *A47C 9/10* (2013.01); *A47C 4/28* (2013.01)

(58) Field of Classification Search

CPC .... A45F 3/26; A47C 4/28; A47C 9/10; A47C 9/105

See application file for complete search history.

(56) References Cited

U.S. PATENT DOCUMENTS

| | | | | |
|---|---|---|---|---|
| 882,850 | A * | 3/1908 | Troell | A01M 31/02 182/187 |
| 2,512,174 | A | 6/1950 | Roeder | |
| 2,711,783 | A | 6/1955 | Prill | |
| 3,030,160 | A | 4/1962 | Tandy | |
| 3,115,213 | A | 12/1963 | Cloutier | |
| 3,340,828 | A | 9/1967 | Smith | |
| 3,419,108 | A | 12/1968 | Mobbs | |

(Continued)

OTHER PUBLICATIONS

Dead Ringer Hunting, "Hammock Seat," available at: https://web.archive.org/web/20161023180005/http://deadringerhunting.com/produtct/hammock, Internet Archive Wayback Machine Capture dated Oct. 23, 2016.

(Continued)

*Primary Examiner* — Philip F Gabler

(74) *Attorney, Agent, or Firm* — Hamilton, Brook, Smith & Reynolds, P.C.

(57) ABSTRACT

An embodiment is a lightweight, packable seat that includes a seat platform, two shafts for support, straps with respective buckles, or similar, that secure the seat to a vertical object, such as a tree. The seat may be made of a lightweight flexible material that is held in a stiff orientation that extends outward from the tree through coupling to the upper strap at the proximal end of the seat and the shafts at a distal end of the seat, where the shafts project downward toward a proximal location at the tree at the lower strap. Use of the lower strap means that the shafts do not contact a ground surface, thereby providing stability. The shafts may be made of composites or aluminum, for example, such that the entire weight of the seat may weigh just a few ounces while exhibiting strengths and stability.

9 Claims, 8 Drawing Sheets

(56) References Cited

U.S. PATENT DOCUMENTS

| | | | | | |
|---|---|---|---|---|---|
| 3,513,940 | A | * | 5/1970 | Ussery | A01M 31/02 182/187 |
| 3,719,252 | A | | 3/1973 | Tiley | |
| 3,749,200 | A | * | 7/1973 | Meyer | A01M 31/02 182/187 |
| 3,885,649 | A | * | 5/1975 | Damron | A01M 31/02 182/187 |
| 3,927,733 | A | * | 12/1975 | Wurn | A01M 31/02 182/187 |
| 4,315,655 | A | | 2/1982 | Machnik | |
| 4,601,364 | A | * | 7/1986 | York | A01M 31/02 108/152 |
| 4,625,833 | A | * | 12/1986 | Lewis | A01M 31/02 108/152 |
| 4,691,804 | A | | 9/1987 | Bunker | |
| 4,705,143 | A | | 11/1987 | Ziemba | |
| 4,730,700 | A | | 3/1988 | Miller et al. | |
| D306,487 | S | | 3/1990 | Fowler, Jr. | |
| 4,924,972 | A | | 5/1990 | Westbrock | |
| 4,936,416 | A | | 6/1990 | Garon | |
| 5,078,232 | A | * | 1/1992 | Hancosky | A45F 3/26 108/152 |
| 5,205,375 | A | * | 4/1993 | Shriver | A01M 31/02 108/152 |
| 5,848,666 | A | * | 12/1998 | Woodall | A01M 31/02 182/187 |
| 6,264,000 | B1 | | 7/2001 | Johnson | |
| 6,328,131 | B1 | | 12/2001 | Backus | |
| 7,258,401 | B2 | | 8/2007 | Smith | |
| 8,015,929 | B2 | | 9/2011 | Tyner | |
| D676,253 | S | | 2/2013 | Springs | |
| 8,757,724 | B2 | | 6/2014 | Woodhams | |
| 8,833,521 | B1 | | 9/2014 | Jude | |
| 9,277,807 | B2 | | 3/2016 | Tichenor | |
| 9,743,774 | B1 | * | 8/2017 | Hauser | A47C 9/10 |
| 2009/0321186 | A1 | | 12/2009 | Louchart | |

OTHER PUBLICATIONS

Robin, Mike, "My Torges Seat" Dec. 1, 2008, piratesofarchery.net, site visited Dec. 12, 2019 <http://piratesofarchery.net/bb/viewtopic.php?p=57900> (Year: 2008).

* cited by examiner

PORTABLE SEAT

RELATED APPLICATION

This application claims the benefit of U.S. Provisional Application No. 62/486,641 filed on Apr. 18, 2017. The entire teachings of the above application are incorporated herein by reference.

BACKGROUND

Typical portable chairs have three or more vertical legs that support a seat platform off the ground. These portable chairs are mechanical, heavy, cumbersome, and unstable without both of user's feet on the ground and can be difficult to set up. Most camping or folding chairs are too cumbersome and heavy to pack for a hiking trip or back country camping.

As such, there is a need for a portable light weight seat that is capable of being easily dissembled and stored in a backpack.

SUMMARY OF THE INVENTION

The present disclosure relates generally to a portable light weight seat, and, more specifically, a portable light weight seat that utilizes a tree or other vertical object as a support.

Embodiments of the present disclosure include a seat with a seating platform with one end attached to a vertical object (e.g., a tree, a post, etc.). The seat includes at least two support shafts attached to the opposite end of the seating platform. The support shafts may be angled from the end of the seating platform opposite the vertical object, down and back toward the vertical object. The lower ends of the support shafts may be attached to the vertical object below where the seating platform is attached to the vertical object. In some embodiments, the support shafts cross each other and may be attached the vertical object above the ground (so as to not touch the ground), as shown in FIG. 1.

The seating platform and lower ends of the support shaft may be attached to the vertical object by any method known in the art. For example, the seating platform and lower ends of the support straps may be attached to the vertical object using adjustable nylon straps or straps made out of any other type of similar material.

According to some embodiments, the seating platform can be adjusted for improved comfort to accommodate an angle of a supporting object. The seating platform and frame, which includes the support shafts, can be adjusted by a user to accommodate variable heights. The seating platform does not rely on the support shafts touching the ground for stability, and thus does not dig into the ground. Further, in some embodiments, attaching the seat to a vertical object using the straps does not damage or harm the vertical object. The disclosed seat is a lightweight, compact, portable, packable, and stable design that accommodates weight budgets for gear of hikers, fishermen, hunters and campers, among other outdoor enthusiasts.

According to at least one example embodiment, the present disclosure may be implemented in the form of an apparatus comprising a seating platform having a proximal end, distal end, and material spanning between the ends. The example embodiment may further include: an upper strap configured to attach to the proximal end of the seating platform, the upper strap configured to secure the seating platform at the proximal end to a vertical object; a lower strap; and at least two support shafts configured to be coupled to the distal end of the seating platform and the lower strap. In some embodiments, the at least two support shafts cross each other between the upper strap and the lower strap.

According to some embodiments, each of the support shafts has a first end configured to be coupled to the distal end of the seating platform and a second end configured to be coupled to the lower strap.

According to some embodiments, the lower strap is coupled to the upper strap and is configured to hang vertically from the upper strap when the upper strap is secured to the vertical object. In some embodiments, the lower strap is a first lower strap, and the apparatus further includes a second lower strap coupled to the upper strap and configured to hang vertically from the upper strap when the upper strap is secured to the vertical object, wherein the first lower strap and the second lower strap are configured to enable the support shafts to be coupled thereto.

According to some embodiments, the lower strap is configured to be secured to the vertical object. In some embodiments, the lower strap includes at least one pocket arranged to enable the at least two support shafts to couple to the lower strap.

Figure 1:
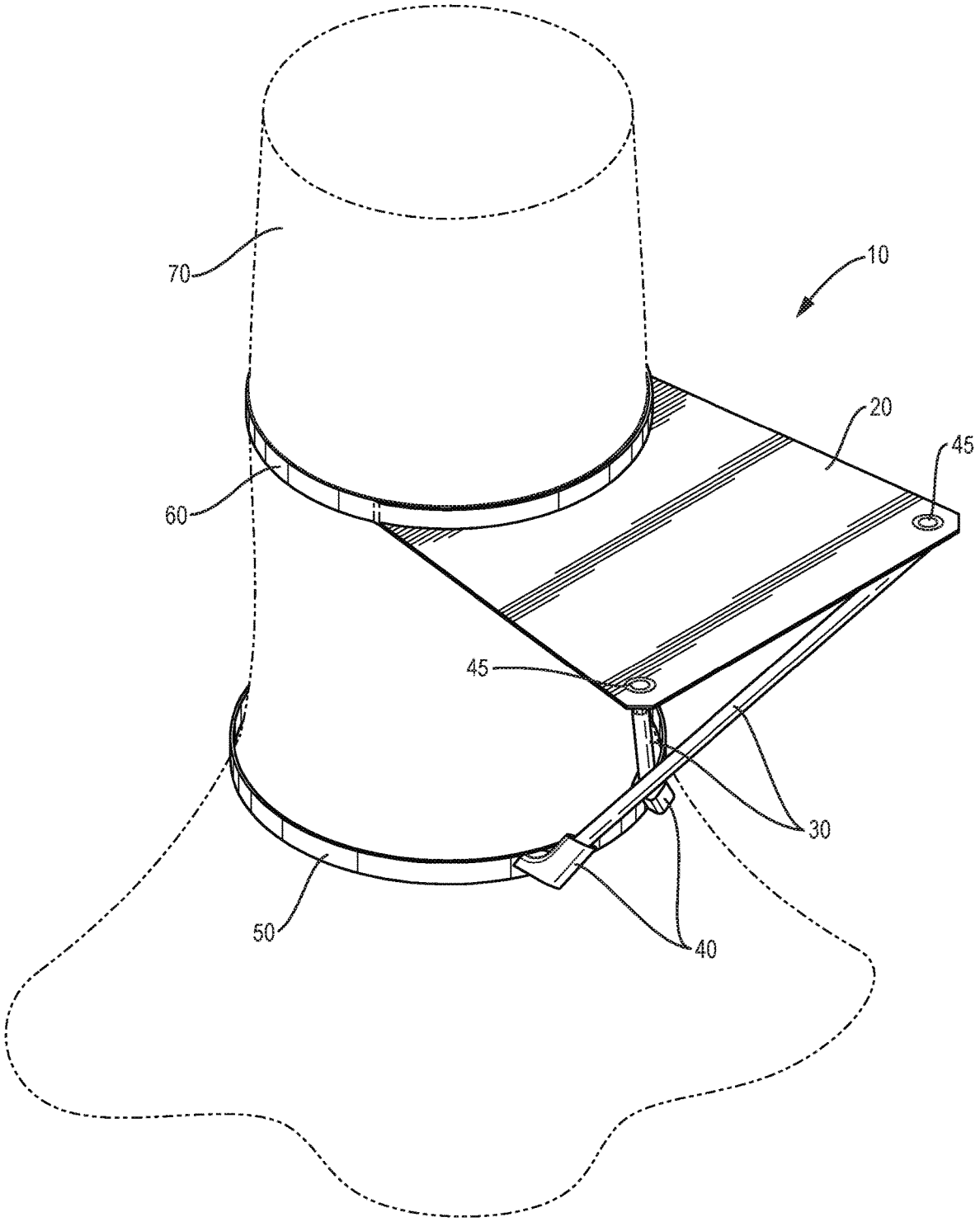
FIG. 1 is an angled view of an example embodiment of the seat illustrating the seat attached a vertical object.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 8A:
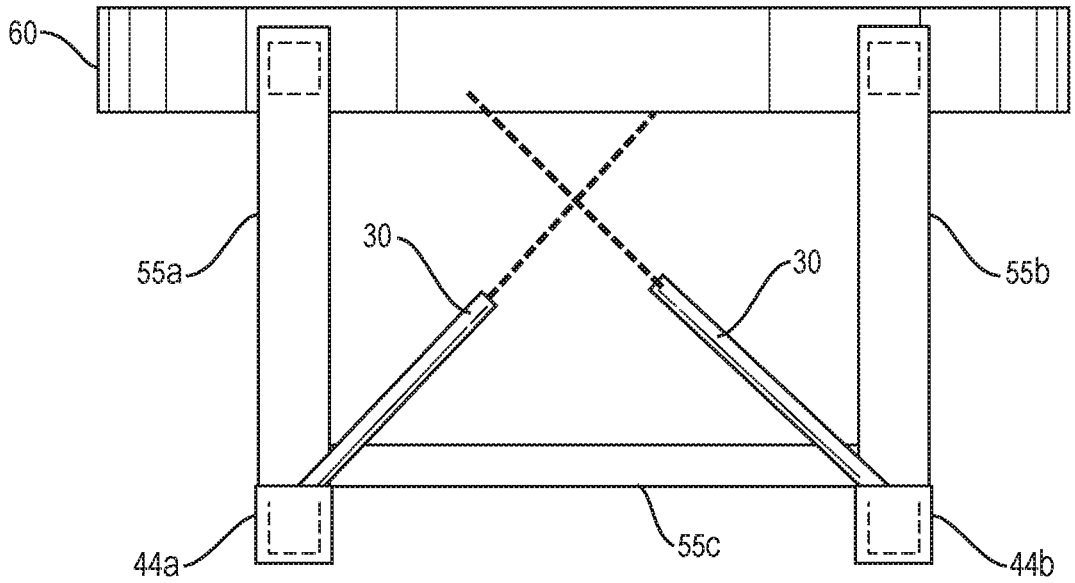
FIG. 8A is an illustration of an example embodiment with two lower straps that hang from the upper strap.
Figure 8B:
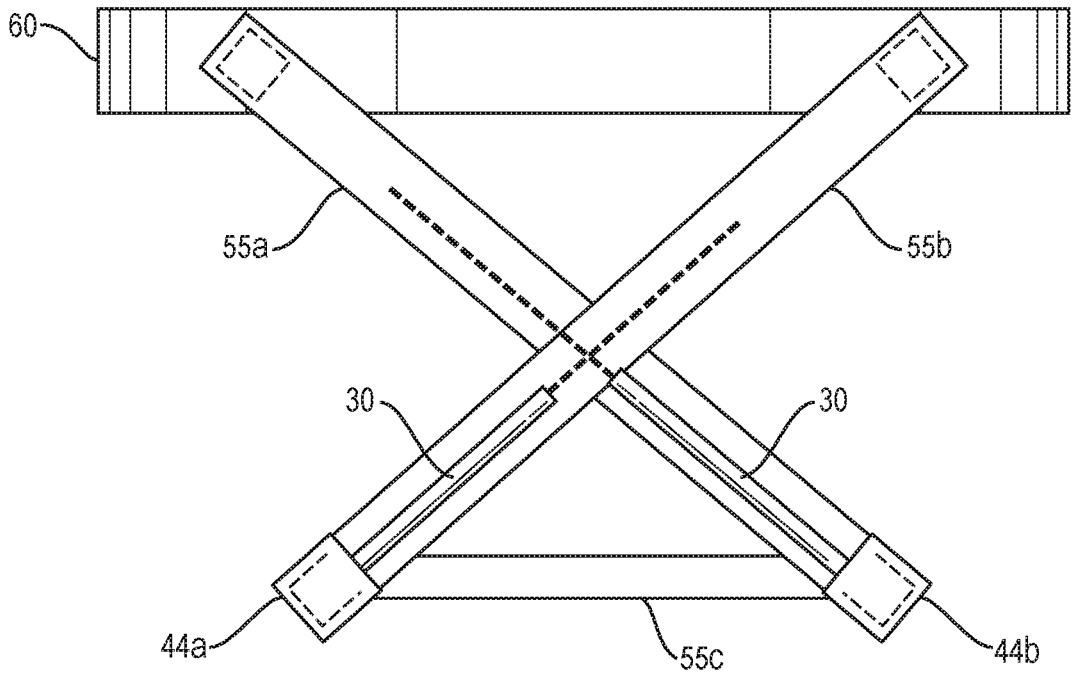
FIG. 8B is an illustration of an example embodiment with two lower straps that hang from the upper strap.

FIGS. 1-5 illustrate an example embodiment of a seat 10 that embodies principles of the disclosed device. FIGS. 6 and 7 illustrate other embodiments. FIGS. 8A and 8B illustrate yet other embodiments.

FIG. 1 is an angled view of the seat 10 illustrating the seat 10 attached a vertical object 70. According to this example embodiment, the seating platform 20 has one end attached to the vertical object 70 (e.g., a tree, a post, etc.) using an upper strap 60. The seating platform 20 may be coupled to or configured to be coupled to the upper strap 60. For example, the seating platform 20 may be sewn onto the upper strap 60 or coupled to the upper strap 60 by another securing mechanism known in the art.

Figure 2:
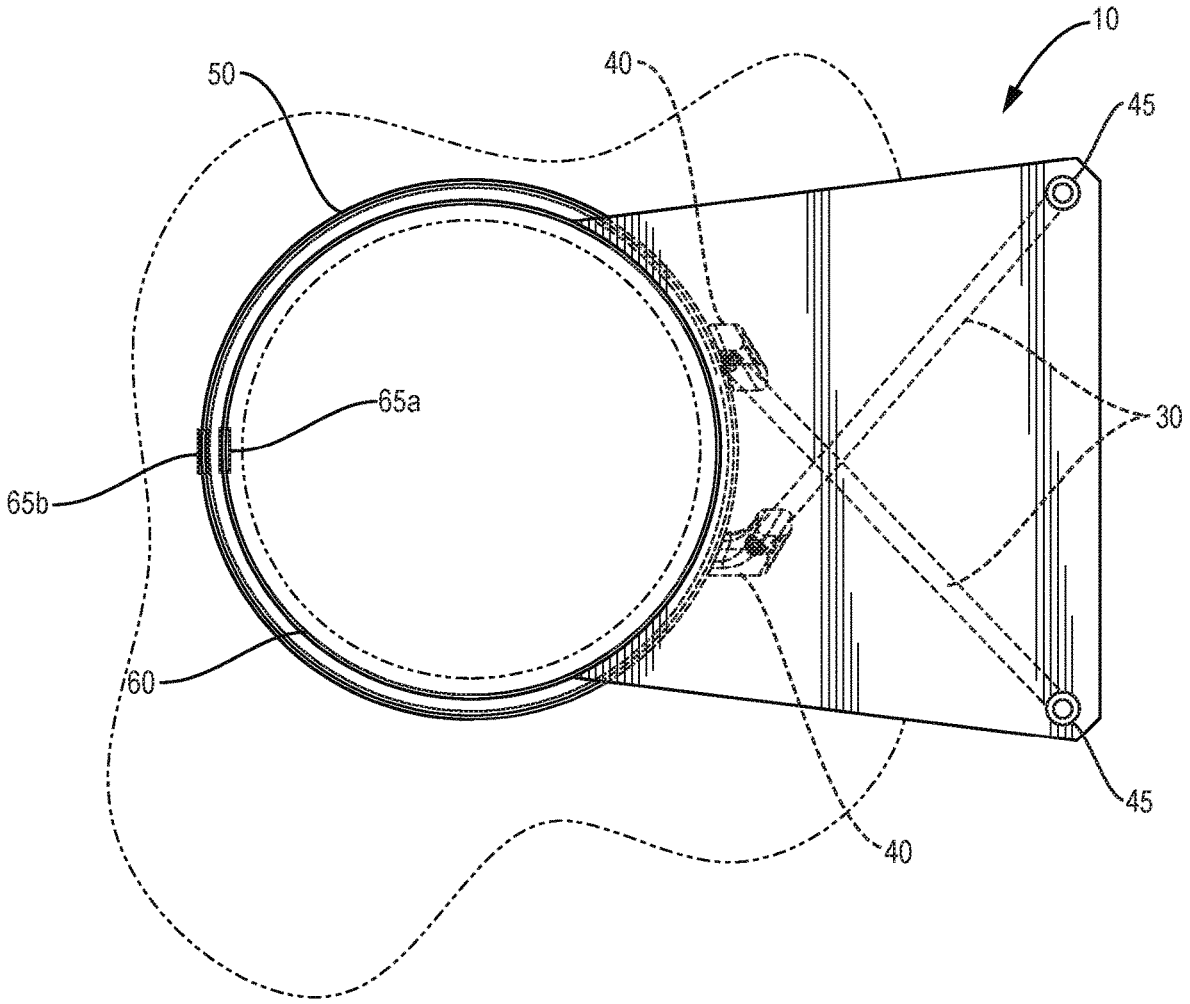
FIG. 2 is a top view of the example embodiment of the seat illustrating the seat attached a vertical object.
Figure 3:
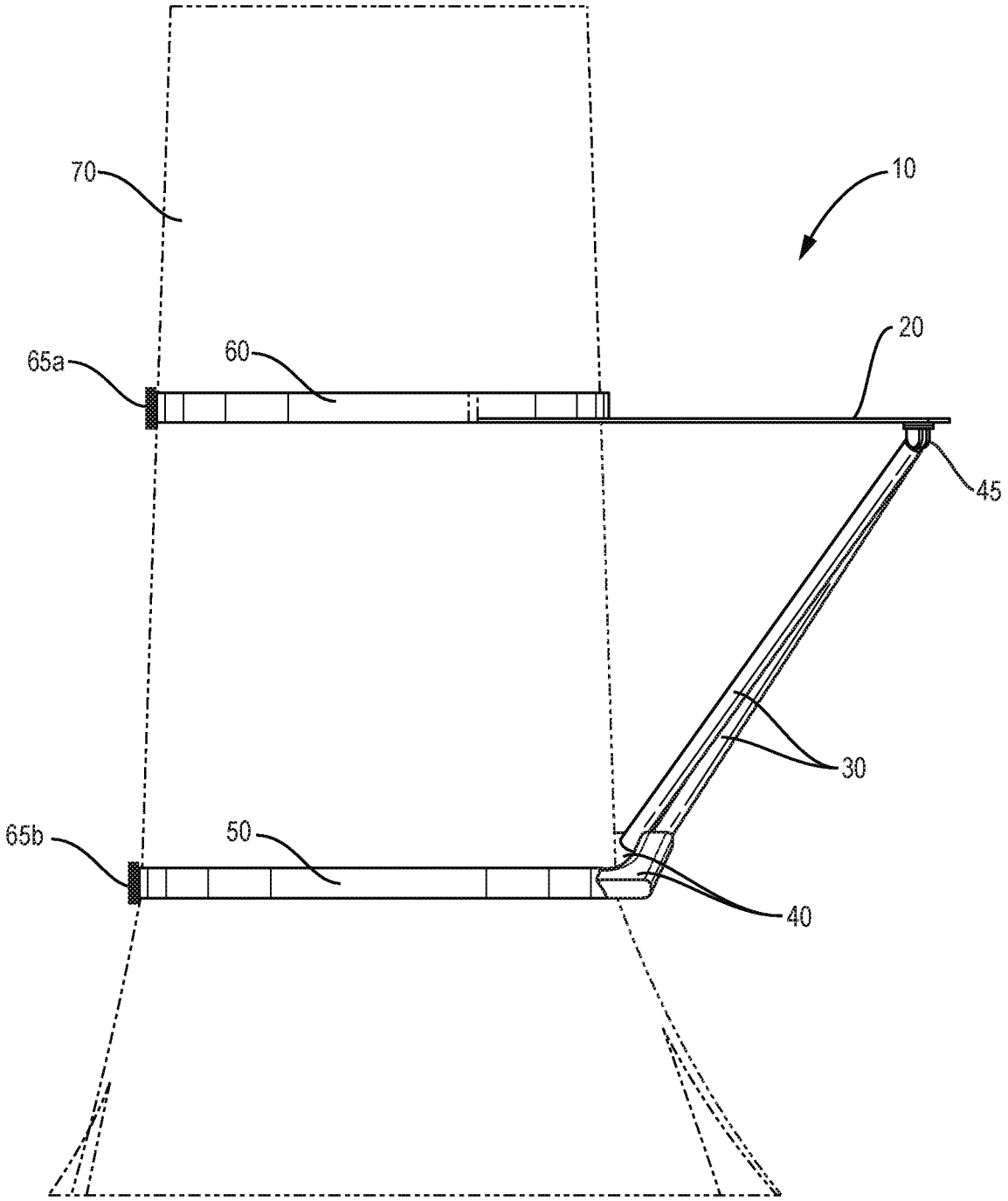
FIG. 3 is a left side view of the example embodiment of the seat illustrating the support shafts supporting the seat platform and the top and bottom of seat attached to a vertical object.
Figure 5:
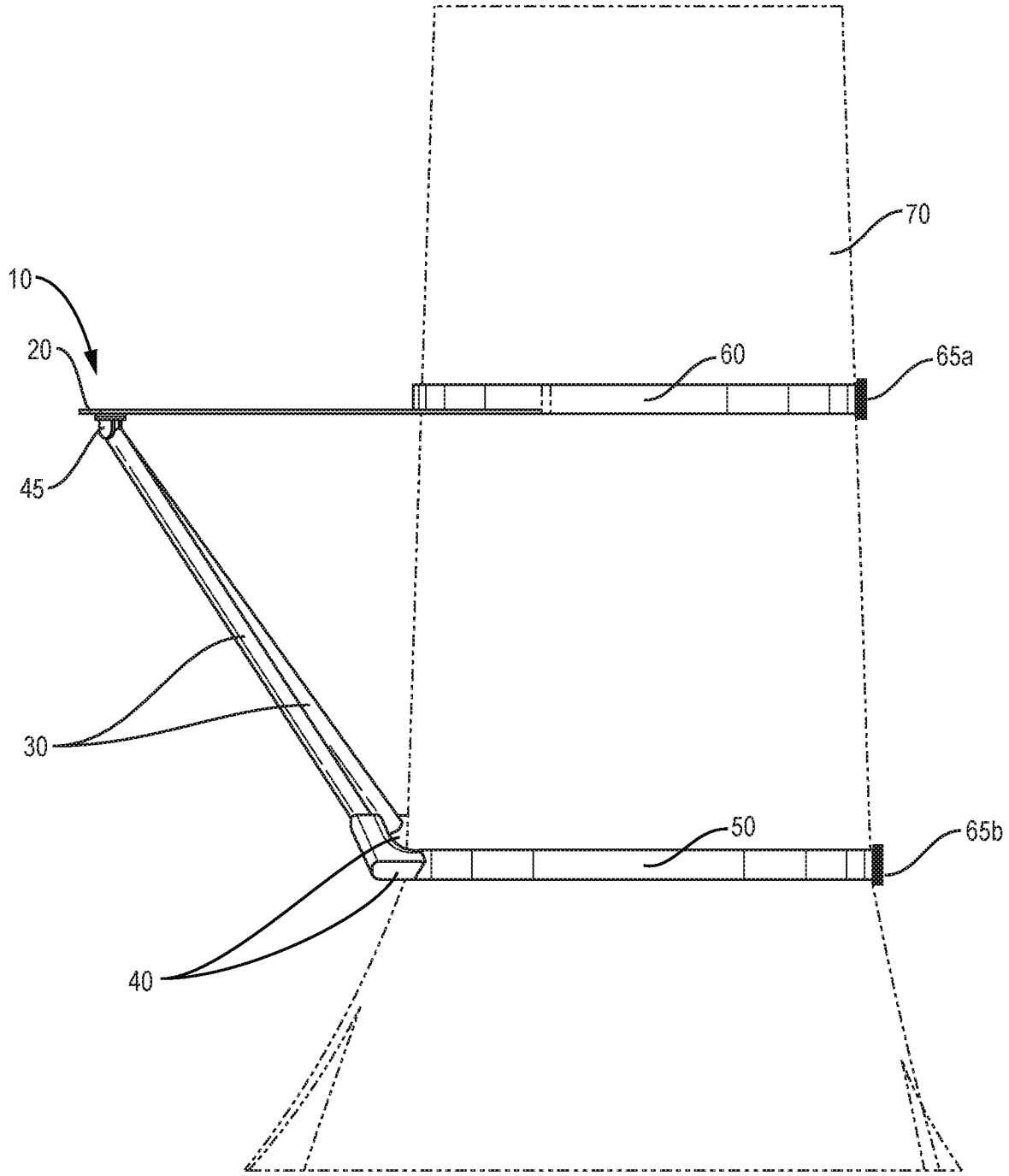
FIG. 5 is a right side view of the example embodiment of the seat.
Figure 6:
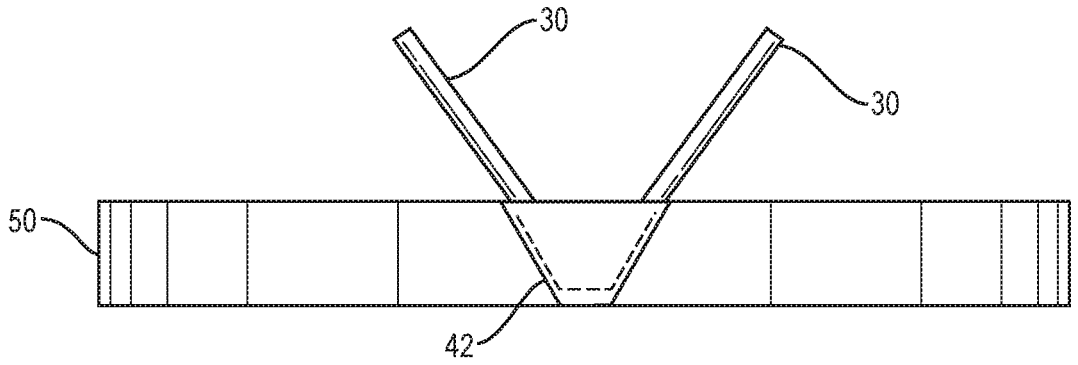
FIG. 6 is an illustration of an example embodiment with a lower strap with a single pocket.

The upper strap 60 may be an adjustable nylon strap that attaches to the vertical object 70 through use of a buckle 65*a* (as shown in FIGS. 2, 3, and 5) or other securing mechanism known in the art. One of skill in the art would understand that the buckle 65*a* may be located anywhere on the upper strap 60 other than the portion of the upper strap 60 directly connected to the seating platform 20, and that location of the buckle 65*a* as shown in FIGS. 2, 3, and 5 is non-limiting.

In other embodiments, the upper strap 60 may be made out of any other suitable material (e.g., cotton, polyester, carbon fiber, texteline, solution-dyed acrylic fabrics, Duracord, or any other type of durable fabric) known in the art, preferably a material that is light weight and strong enough to support the body weight of an adult. Similarly, the seating platform 20 may be made from numerous types of materials known in the art including nylon, cotton, polyester, carbon fiber, ripstop, texteline, solution-dyed acrylic fabrics, Duracord, or any other type of durable fabric.

According to the example embodiment in FIG. 1, two support shafts 30 are attached to the end of the seating platform 20 opposite to the vertical object 70. The support shafts 30 may be attached or fastened to the end of the seating platform 20 using grommets 45 or any other suitable way to attach a shaft or pole to fabric so that the shaft can be easily disassembled or removed from the fabric. For example, the support shafts 30 may have smaller end points that insert into the grommets 45 holding the support shafts 30 in place. The support shafts 30 may be angled from the end of the seating platform 20 back toward the vertical object 70. The lower ends of the support shafts 30 may be attached to the vertical object 70 below where the seating platform 20 is attached to the vertical object 70.

According to the example embodiment, the two support shafts 30 may be attached to the lower support strap 50 by inserting the lower ends of the support shafts 30 into pockets 40 attached to the lower support strap 50. For example, the pockets 40 may be sewn onto the lower strap 50 or attached to the lower strap 50 by another securing mechanism known in the art.

The lower support strap 50 is attached to the vertical object 70 below the upper support strap 60. The lower strap 50 may be an adjustable nylon strap that attaches to the vertical object 70 through use of a buckle 65*b* (as shown in FIGS. 2, 3, and 5) or other securing mechanism known in the art. One of skill in the art would understand that the buckle 65*b* may be located anywhere on the lower strap 50 other than the portion of the lower strap 50 directly connected to the pockets 40, and that location of the buckle 65*a* as shown in FIGS. 2, 3, and 5 is non-limiting.

As described above in regard to the upper support strap 60, the lower support strap 50 may be made out of any suitable material (e.g., nylon, cotton, polyester, carbon fiber, texteline, solution-dyed acrylic fabrics, Duracord, or any other type of durable fabric) known in the art. In some embodiments, a material that is lightweight and strong enough to support the body weight of an adult seated on the seating platform 20 is used. The lower strap 50 may be an adjustable strap that attaches to the vertical object 70 with a buckle 65. It should be understood that other fastening components may be employed, such as hook and loop materials, pins and fasteners, clips, and other components that enable coupling of two portions of a strap or a strap and a seating platform to be temporarily or permanently interconnected.

FIG. 2 is a top view of the seat 10 illustrating the seat 10 attached a vertical object 70 with each support shaft 30 angled from a respective corner of the seat platform 20 to a diagonal, respective, lower support strap pocket 40. This support shaft arrangement stabilizes the seat platform 20 and increases the amount of weight the seat 10 is able to support.

FIG. 3 is a left side view, and FIG. 5 is a right side view of the seat 10. Both figures illustrate the support shafts 30 supporting the seat platform 20 and the upper strap 60 and the lower strap 50 attaching the seat 10 to the vertical object 70.

Figure 4A:
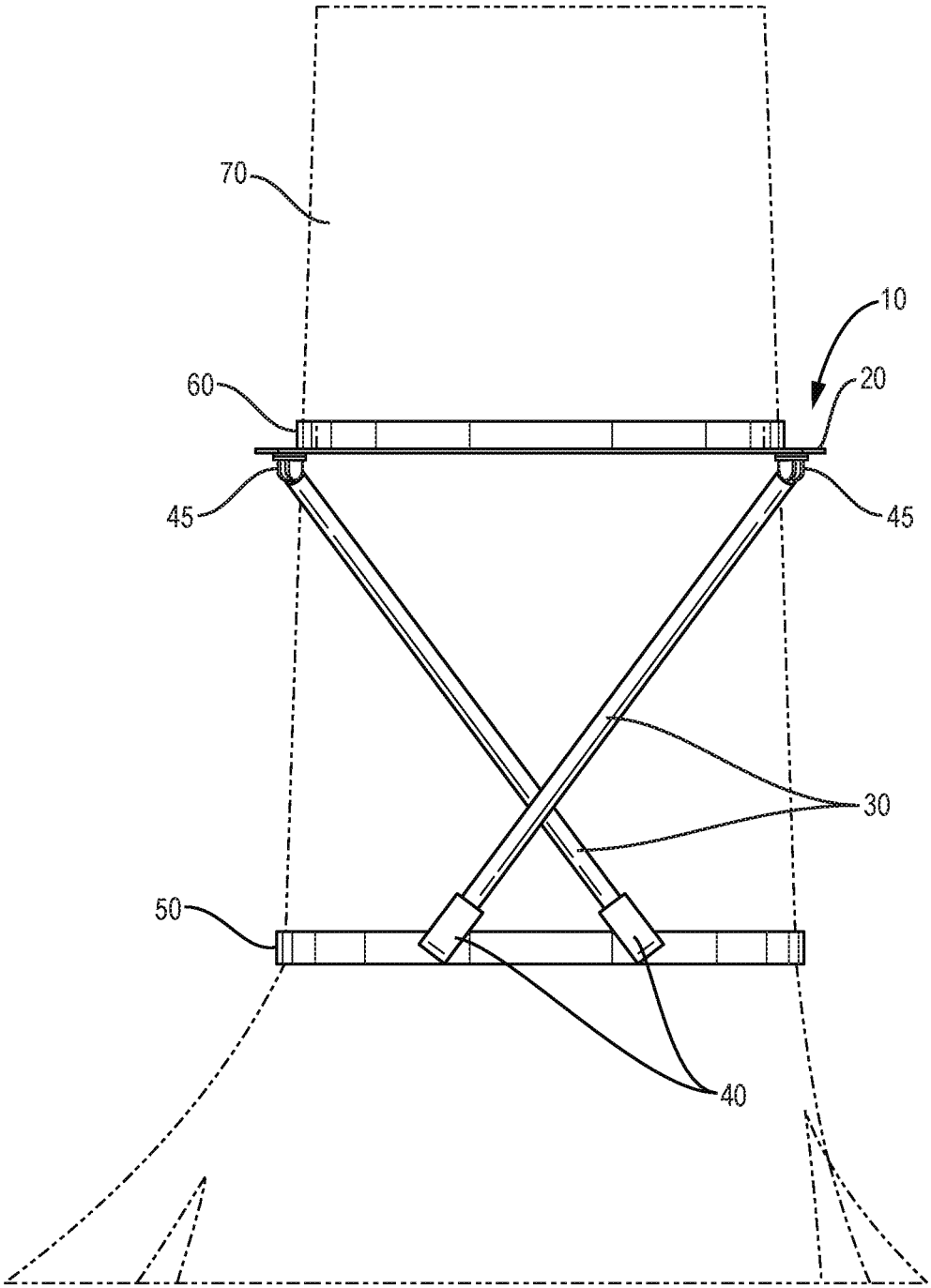
FIG. 4A is a front view of the example embodiment of the seat illustrating crossed support shafts supporting the seat platform.

FIG. 4A is a front view of the seat 10 illustrating the support shafts 30 crossing each other to support the seat platform 20. In other embodiments, the support shafts 30 may not cross. For example, the lower ends of the support shafts 30 may meet where the lower ends attach to the lower strap 50. However, crossing the support shafts 30 and attaching the support shafts to the vertical object 70 stabilizes the seat platform 20 and increases the amount of weight the seat 10 is able to support. A support shaft may be made of any material known in the art, for example, carbon fiber, aluminum, steel, wood, plastic, etc. In one embodiment, the support shafts 30 are composed of a durable, strong and light weight material.

Figure 4B:
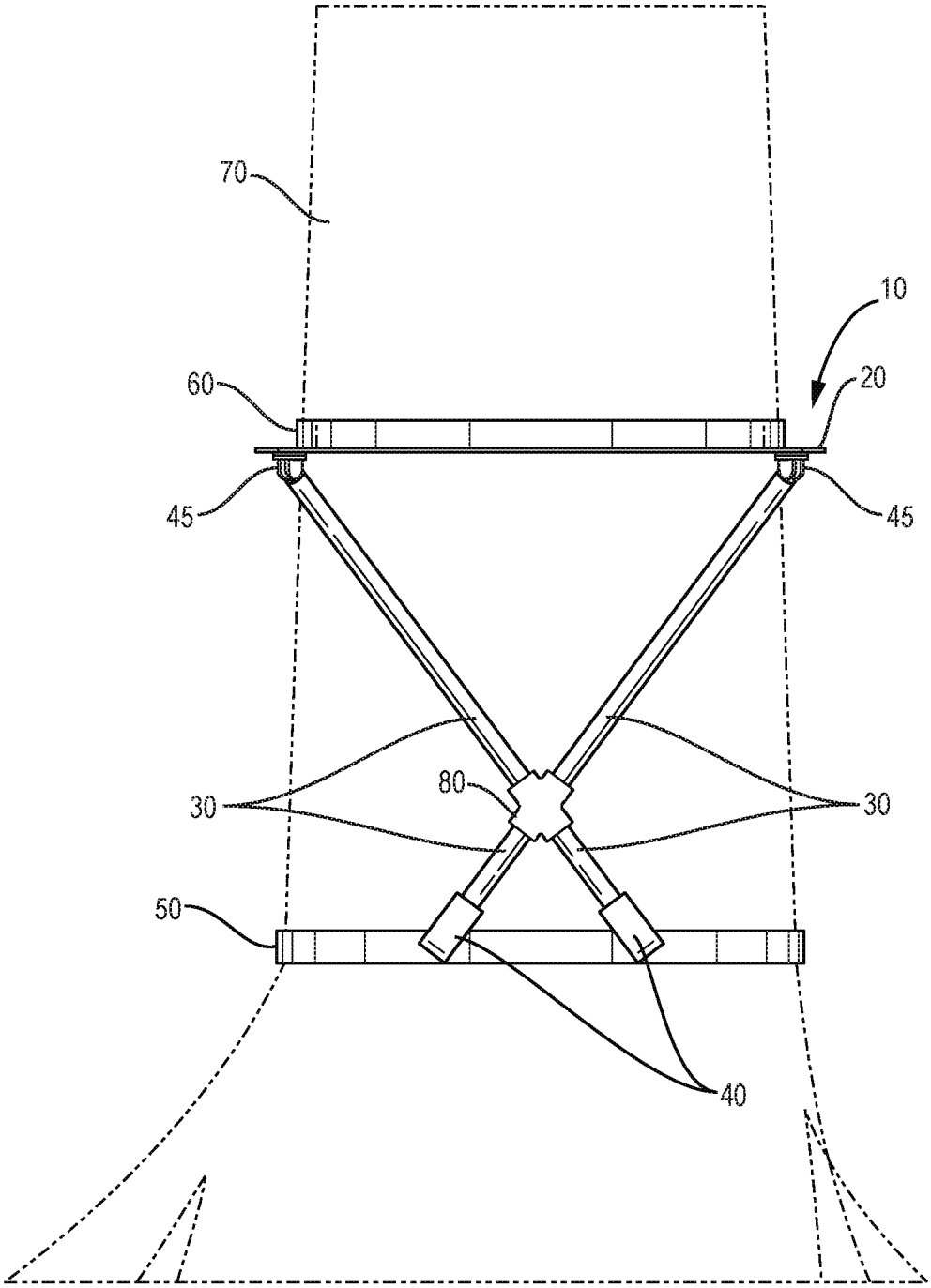
FIG. 4B is front view of another example embodiment of the seat illustrating support shafts meeting at a four way joint to support the seat platform.

FIG. 4B is front view of another example embodiment of the seat 10 illustrating support shafts 30 meeting at a four way joint 80 to support the seat platform 20. In this example embodiment, instead of two support shafts 30 crossing each other as shown in FIG. 4A, the seat 10 may have four support shafts 30 meet at a four way joint 80 (i.e., central coupling). In this embodiment, the seat 10 would include four support shafts 30 with two support shafts 30 configured to couple to the distal end of the seating platform 20 and the four way joint 80, and two support shafts 30 configured to couple to the lower strap 50 and the four way joint 80. Some embodiments of the seat 10 may utilize three support shafts 30, with one of the support shafts coupling to the distal end of the seating platform 20, passing through the joint 80, and coupling to the lower strap 50.

Embodiments of the disclosed seat are lightweight, packable and portable. The seat is also easy to set up and disassemble. In one embodiment, to disassemble the seat, a user only needs to remove the support shafts from the grommets 45 in the seating platform and the pockets attached to the lower strap, and unbuckle both straps from the vertical object. The straps, seat platform and shafts can then be compactly stored. The seat is capable of supporting people of various sizes. The seat utilizes a vertical object, such as a tree, for support which reduces the size and weight of the seat. The seat may be used by hikers and back country campers who wish to avoid carrying anything bulky or weighing more than a few ounces. Some embodiments may weigh a few ounces, whereas others may weigh up to a few pounds. Still other may weigh between those two ranges. Weight is a function of materials that compose the components of the seat 10.

According to some embodiments, the support shafts may be telescoping and capable of reducing in length for being stored. The telescoping support shafts may be held in an extended position with detents, pins, or other extension or interconnection means (not shown) as is known in the art.

According to some embodiments, the lower strap 50 may be coupled to a single lower pocket 42 that is capable of holding two or more support shafts 30 to the lower strap 50 as shown in FIG. 6. In this embodiment, the support shafts 30 do not cross each other; instead, the support shafts 30 are angled from the end of the seating platform 20 distal from the vertical object 70, down and back toward respective locations at the lower strap proximal to the vertical object.

Figure 7:
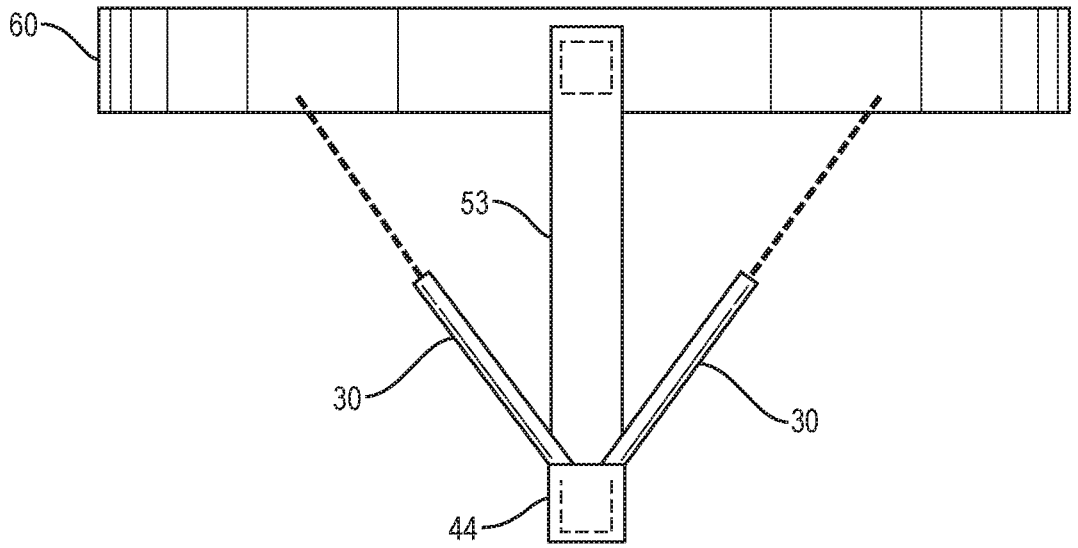
FIG. 7 is an illustration of an example embodiment with a single lower strap that hangs vertically down from the upper strap.

FIGS. 7-8B illustrate example embodiments with one or more lower straps hanging vertically from the upper strap. The one or more lower straps may be coupled to the upper strap in any number of ways, such as being sewn to the upper strap or looped around upper strap. The one or more lower straps may have means to couple the ends of the support shafts to the one or more lower straps, such as pockets, loops, or grommets.

FIG. 7 illustrates an example embodiment with one vertical lower strap 53 with a pocket 44 capable of receiving the support shafts 30. According to this embodiment, no horizontal lower strap is necessary; however, a horizontal lower strap, such as the lower strap 50, may be included for additional support. In this embodiment, the support shafts 30 may not cross each other, and may be angled from the end of the seating platform 20 the vertical object, down and back toward locations at the lower strap proximal to the vertical object.

FIG. 8A illustrates an example embodiment with two vertical lower straps 55*a*, 55*b*, each with a respective pocket 44*a*, 44*b* capable of receiving one of the support shafts 30. Optionally, the two lower straps 55*a*, 55*b* may be coupled to each other with a third horizontal strap 55*c* for extra stability through providing more surface area connection against the vertical object and preventing possible spreading apart of the vertical straps 55*a*, 55*b* under a loading condition. Typically, however, the force of the weight on the seating platform pushes the ends of the vertical straps 55*a*, 55*b* against the vertical object, thus stabilizing the seat. Alternatively, the support shafts may cross each other or extend downward from the seating platform without crossing each other. In some embodiments, the support shafts 30 may be angled from the end of the seating platform 20 distal from the vertical object, down and back toward respective locations at the lower strap proximal to the vertical object.

FIG. 8B illustrates an example embodiment with two vertical lower straps 55*a*, 55*b* that are angled to cross each other. In some embodiments, each vertical lower strap has a respective pocket 44*a*, 44*b* capable of receiving one of the support shafts 30. Optionally, the two lower straps 55*a*, 55*b* may be coupled to each other with a third horizontal strap 55*c* for extra stability, as described above. Alternatively, the support shafts may cross each other or extend downward from the seating platform without crossing each other. In some embodiments, the support shafts 30 may be angled from the end of the seating platform 20 distal from the vertical object, down and back toward respective locations at the lower strap proximal to the vertical object.

While this invention has been particularly shown and described with references to example embodiments thereof, it will be understood by those skilled in the art that various changes in form and details may be made therein without departing from the scope of the invention encompassed by the appended claims.

What is claimed is:

1. A portable seat comprising:

a flexible material having a proximal end and a distal end;

an upper strap coupled to or configured to be coupled to the proximal end of the flexible material, the upper strap configured to secure the flexible material at the proximal end to a vertical object;

a lower strap including at least one coupling feature; and at least two support shafts configured to be coupled to the distal end of the flexible material and the at least one coupling feature of the lower strap, the at least two support shafts including a first support shaft coupled to a first location of the distal end of the flexible material and a second support shaft coupled to a second location of the distal end of the flexible material, wherein the first location and the second location are separated, the at least two support shafts being configured to drive the first location of the distal end away from the second location of the distal end and to drive the distal end away from the proximal end in response to weight of a user applied to the flexible material, thereby enabling the flexible material to serve as a seating platform.

2. The portable seat of claim 1 wherein each of the support shafts has a first end configured to be coupled to the distal end of the flexible material and a second end configured to be coupled to the lower strap.

3. The portable seat of claim 1 wherein the lower strap is coupled to the upper strap and is configured to hang vertically from the upper strap when the upper strap is secured to the vertical object.

4. The portable seat of claim 3 wherein the lower strap is a first lower strap and further including a second lower strap coupled to the upper strap and configured to hang vertically from the upper strap when the upper strap is secured to the vertical object, wherein the first lower strap and the second lower strap are configured to enable the support shafts to be coupled thereto, respectively.

5. The portable seat of claim 1 wherein the lower strap is configured to be secured to the vertical object.

6. The portable seat of claim 5 wherein the at least one coupling feature includes at least one pocket arranged to enable the at least two support shafts to couple to the lower strap.

7. The portable seat of claim 1 wherein the at least two support shafts cross each other between their respective coupling locations at the distal end of the flexible material and the lower strap.

8. The portable seat of claim 1 comprising at least four support shafts, each of the at least four support shafts coupling to a four way joint.

9. The portable seat of claim 1 wherein the flexible material spanning between the ends is a fabric.

* * * * *